US005096398A

United States Patent [19]

Cozens

[11] Patent Number: 5,096,398

[45] Date of Patent: Mar. 17, 1992

[54] PULSE TUNED OPTIMIZED POSITIVE DISPLACEMENT PORTING

[75] Inventor: Eric Cozens, Oakville, Canada

[73] Assignee: Stackpole Limited, Mississauga, Canada

[21] Appl. No.: 611,746

[22] Filed: Nov. 13, 1990

[51] Int. Cl.[5] ..... F04C 2/10

[52] U.S. Cl. ..... 418/171; 418/180

[58] Field of Search ..... 418/170, 171, 172, 166, 418/180

[56] References Cited

U.S. PATENT DOCUMENTS 3,995,978 12/1976 Kahn et al. ..... 418/171
4,658,583 4/1987 Shropshire ..... 418/171
4,767,296 8/1988 Satomoto et al. ..... 418/171

FOREIGN PATENT DOCUMENTS 1-273887 11/1989 Japan ..... 418/171
2-191887 7/1990 Japan ..... 418/171

*Primary Examiner*—Richard A. Bertsch
*Assistant Examiner*—David L. Cavanaugh
*Attorney, Agent, or Firm*—Eugene J. A. Gierczak

[57] ABSTRACT

This invention relates to a porting system for a hydraulic device comprising a housing having a chamber communicating with an intake port and an exhaust port; a pair of rotary gears disposed internally of said chamber adjacent said ports and defining expanding and contracting pockets as said gears rotate over said intake and exhaust ports; said ports having a cross-sectional area in the direction perpendicular to the rotation which varies in relation to the rate of change of the expanding and contracting pockets.

20 Claims, 4 Drawing Sheets

PULSE TUNED OPTIMIZED POSITIVE DISPLACEMENT PORTING

FIELD OF INVENTION

This invention relates to porting system for hydraulic devices and in particular relates to gerotor oil pumps having an intake port and exhaust port with a cross-sectional area in direction of rotation of said gears which varies in relation to the rate of change of the pockets between the gear teeth.

BACKGROUND TO THE INVENTION

Positive displacement porting systems on gerotor oil pumps generally consist of an intake port, an exhaust and an internal relief system which directs relief oil from the exhaust port back into the intake port.

There have been various designs heretofore in oil pumps including gerotors oil pumps in order to efficiently pump fluids.

For example, U.S. Pat. No. 3,289,599 relates to a gear pump.

More particularly, U.S. Pat. No. 3,995,978 teaches inlet ports which are generally arcuate or kidney shaped which extend circumferentially for approximately the line of eccentricity on one side of the hydraulic device to approximately the line of eccentricity on the opposite side of the hydraulic device.

Moreover, U.S. Pat. No. 4,492,539 illustrates a gerotor pump having displacement control means for changing the volume of fluid delivered.

Yet another arrangement illustrated in U.S. Pat. No. 4,767,296 which shows that when the in rotor rotates, a sealed space has its volume reduced to have internal oil pressure accumulated.

Finally, U.S. Pat. No. 4,758,130 discloses various arrangement of ports or galleries of a pump.

These an other arrangements of hydraulic pumps and in particular porting systems have generally limited utility.

It is an object of this invention to provide a more efficient porting system for hydraulic devices and in particular to provide a more efficient porting system for gerotor oil pumps.

It is an aspect of this invention to provide a porting system for a hydraulic device comprising; a housing having a chamber communicating with an intake port and an exhaust port; a pair of rotary gears disposed internally of said chamber adjacent said ports and defining expanding and contracting pockets as said gears rotate over said intake port and said exhaust port respectively; wherein said ports have a cross-sectional area in the direction of rotation which varies with the angular displacement of said gears whereby the incremental rate of change of said cross-sectional area is based on said rate of change of said expanding and contracting pockets.

It is another aspect of this invention to provide a hydraulic pump for pump fluids comprising; a housing having an intake passage for introducing said fluid, exhaust passage for exhausting said fluid and an end face, said intake and exhaust passage defining at said end face and intake port for receiving said fluid and said exhaust port for exhausting said fluid; an internally tooth rotor having an axis of rotation and an externally tooth rotor eccentrically disposed within said internally tooth rotor and having an axis of rotation, said axis of rotation being spaced apart; a shaft operatively connected to one of said rotors; said teeth of said rotors inter engageable to define a plurality of expanding and contracting volumes as said rotors rotate about said intake port and said exhaust port respectively; said ports having a cross-sectional area in said axial direction which changes with the angular displacement of said rotor, whereby the increment rate of change of the cross-sectional area along the entire port is inversely proportional to the incremental rate of change of expanding and contracting volumes respectively.

It is a further aspect of this invention to provide a method of maintaining a substantially constant acceleration of fluid within the entire area of an intake port and an exhaust port defined by an intake passage and an exhaust passage communicating with a chamber having rotary gears defining expanding and contracting pockets as said gears rotate within said chamber by utilizing ports having a cross-sectional area in the direction perpendicular to said rotation of said gears which with the angular displacement of the rotary gear whereby the incremental rate of change of the cross-sectional area is inversely proportional to the rate of change of change of said expanding and contracting pockets.

It is yet another aspect of this invention to provide a method of producing an intake port and exhaust port in a hydraulic device having a fluid chamber with rotary gears disposed within said fluid chamber adjacent said port so as to define expanding and contracting pockets as said rotary gears rotate about an access within said fluid chamber, said method comprising the steps of:

(a) determining the radial and axial size of said ports;
(b) determining the initial and final depth or said ports;
(c) determining the rate of change of said pockets as said rotary gears rotate about said ports;
(d) manufacuture the depth of said ports wherein the cross-sectional area of said passages varies in relation to the rate of change of said expanding and contracting pockets.

DESCRIPTION OF THE DRAWINGS

These and other objects and features of the invention shall now be described in relation to the following drawings.

DESCRIPTION OF THE INVENTION

Like parts shall be given like numbers throughout the figures.

Figure 1:
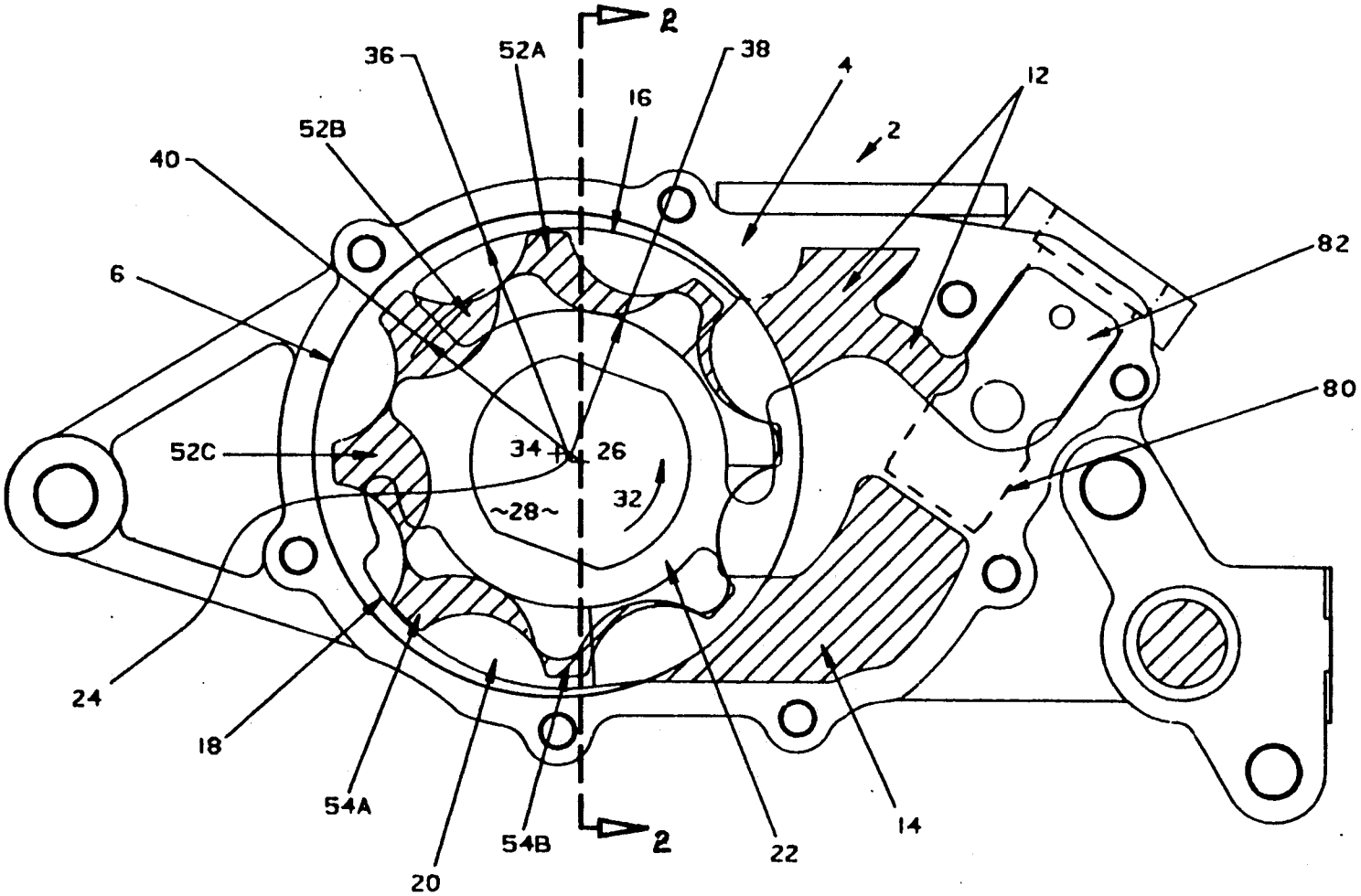
FIG. 1 illustrates a top view of said parts with the relief valve.
Figure 2:
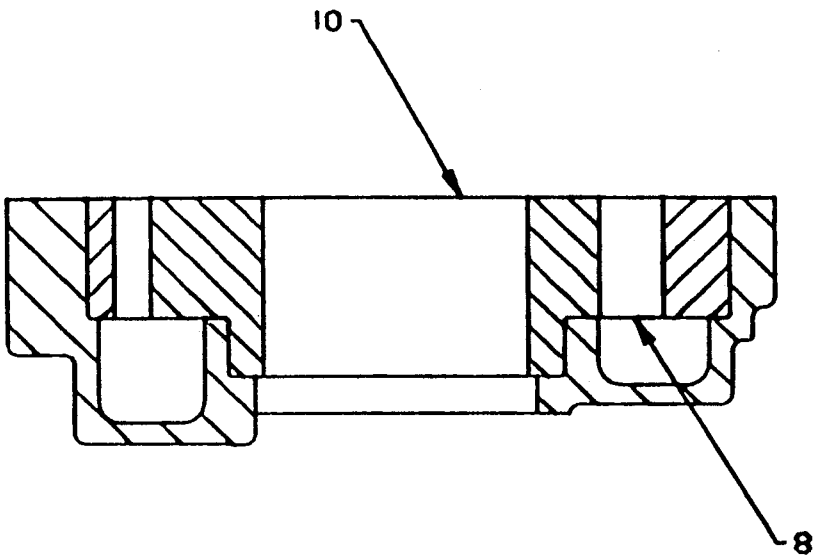
FIG. 2 illustrates a cross-sectional view of said port depth along the lines 2—2 of FIG. 1.

FIG. 1 generally illustrates the hydraulic pump or gerotor pump 2 having a housing 4 which inlcudes a chamber 6 which is illustrated in FIGS. 1 and 2 comprises of a recess or hole having a cylindrical cross-section. The chamber 6 also include a flat end face 8 as best illustrated in FIG. 2.

It should be noted that the housing 2 as illustrated herein is adapted to be either bolted to an engine block along surface 10 by means of bolts or the like (not shown) so as to produce a sealed unit in a manner well known to those persons skilled in the art.

The hydraulic device 2 also includes intake passage 12 adapted to receive fluids such as oil as well as exhaust passage 14 adapted to the exhaust fluids such as oil.

The intake and exhaust passage 12 and 14 communicate with chamber 6 and in particular communicate with end face 8 through intake ports 16 and exhaust port 18.

Chamber 6 is adapted to receive first or inner tooth rotor gear 20 and second or externally tooth rotor gear 22 eccentrically disposed within the inner tooth rotor gear 20. Inner tooth rotor gear 20 is adapted for rotation within chamber 6 about a first axis 24 while a second or externally tooth rotor gear 22 is adapted to rotate about a second axis 26 which is spaced apart from first axis 24 as best illustrated in FIG. 1.

A shaft 28 is operably connected to inner rotor 22 as illustrated in FIG. 1. However, the shaft 28 may be operably connected to either the inner tooth rotor 20 or externally tooth rotor 22.

Figure 3:
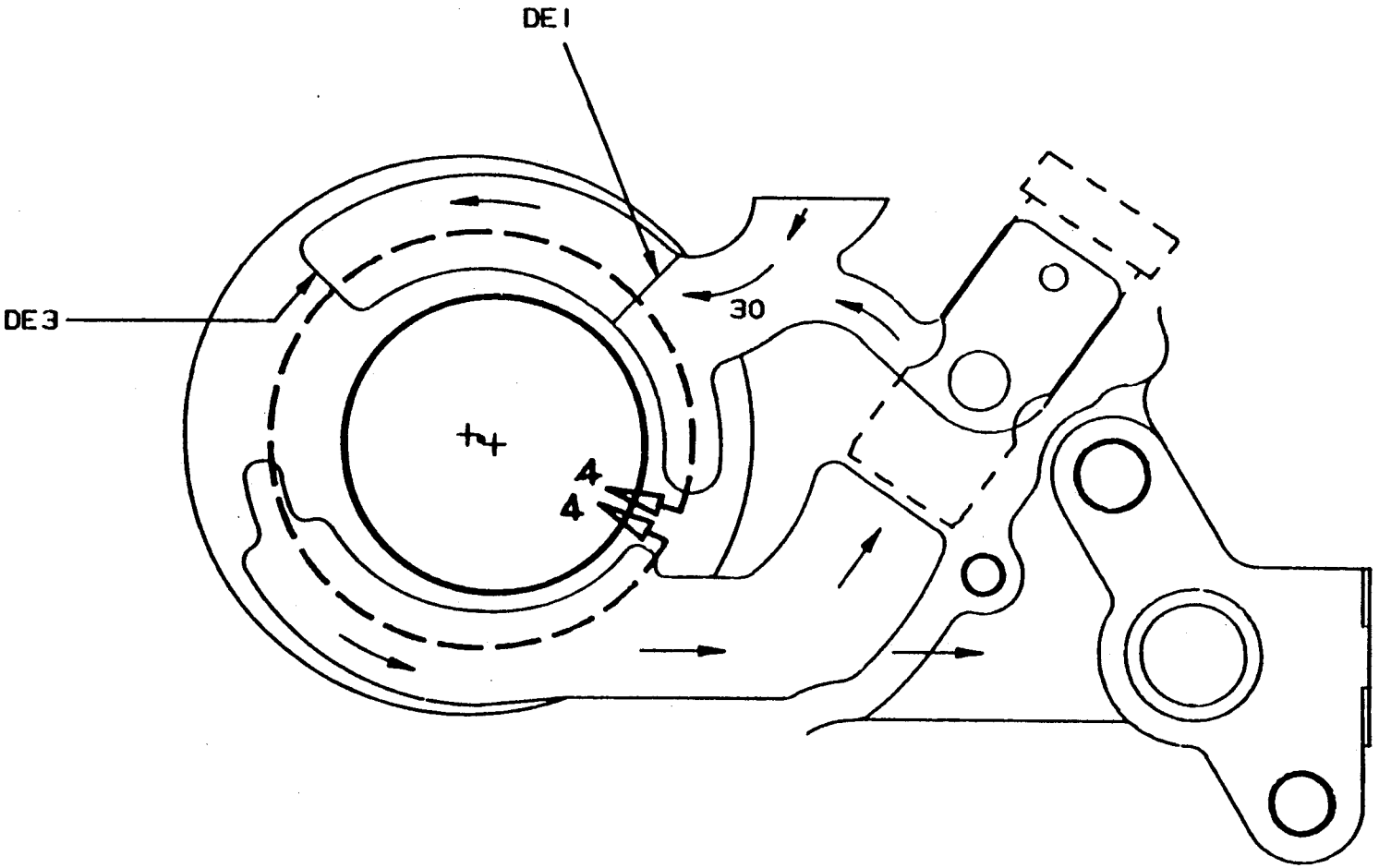
FIG. 3 illustrates a top view of said ports with rotors.

The arrows 30 illustrated in FIG. 3 shows the direction of oil flow.

Moreover, arrow 32 shows the direcion of rotation of rotors 20 and 22. Axis 26 also defines the origin of inner rotor 22. Point 34 in FIG. 1 shows the half-way point of the off-set or half the distance between axis 24 and 26. Numeral 36 defines the outer port radius, while 38 defines the inner port radius. Moreover, 40 illustrates the major radius of the inner rotor 22. Inner tooth rotary gear 20 and externally tooth rotor gear 22 define a series of expanding volumes or pockets 52(*a*), (*b*), and (*c*), as well as a series of contracting volumes or pockets 54(*a*) and (*b*) as best illustrated in FIG. 1. The expanding pockets 52(*a*), (*b*) and (*c*) as disposed adjacent the intake port 16 while the contracting 54(*a*) and (*b*) are disposed adjacent the exhaust port 18. The expanding pockets 52 have the effect of drawing fluid from the intake passage 12 and intake port 16 which will then be transported by the rotating gears 20 ad 22 in a rotary direction of arrow 32 to be exhausted through exhaust passage 14 by means of the contracting pockets 54(*a*) and (*b*) which force the fluid through the exhaust port 18 and out through exhaust passageway 14.

As best illustrated in FIG. 2 the gears 20 and 22 have the same depth or dimension in the axial direction of axis 26 or 34.

In accordance with the invention as described herein, the axial depth 60 of intake port 16 as well as the axial depth 62 of the exhaust port 18 are manufactured in a manner such that the port depth 60 and 62 of intake port 16 and exhaust port 18 have a cross-sectional area in the direction of rotation of the gears 20 and 22 in relation to the rate of change of the gears 20 and 22 in relation to the rate of change of the expanding and contracting volumes or pockets 52 and 54. In particular, the cross-sectional area of intake port 16 and exhaust port 18 varies in relation to the rate of change of the expanding and contracting pockets 52 and 54 in a direction perpendicular to the direction of rotation.

Figure 4:
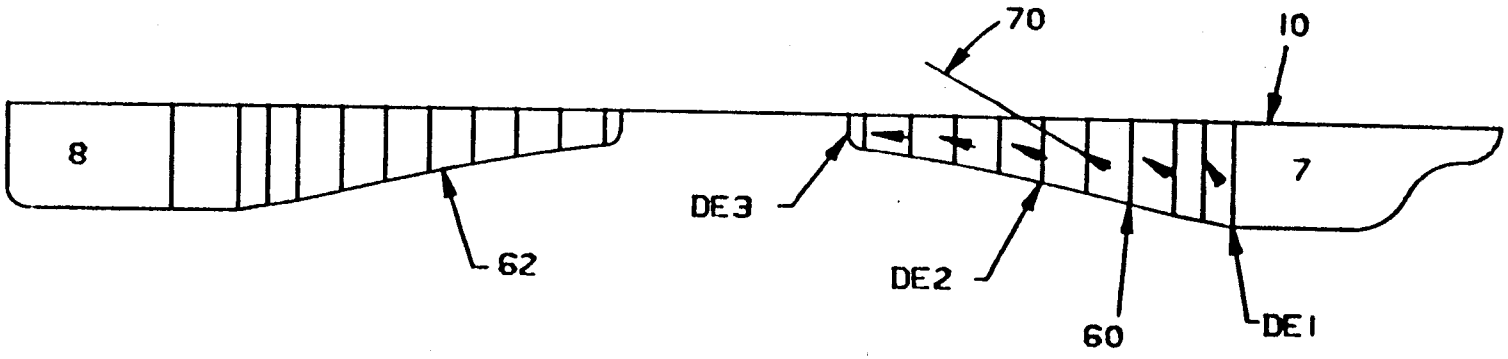
FIG. 4 illustrates a side elevational view of said ports along the lines 4—4 of FIG. 3.

FIG. 4 best illustrates the axial depth 60 of intake port 16 as well as the axial depth 62 of exhaust port 18 along the direction of rotation of the rotors 20 and 22 along lines B—B as shown in FIG. 3. In particular, line B—B is taken along an arc which approximately represents the middle of the ports 16 and 18.

In other words, as the expanding pocket 52(*a*) expands to the size of expanding pocket 52(*b*), the depth of the intake port $DE_1$ becomes smaller as illustrated by $DE_2$. In other words, the cross-sectional area of the intake port 16 which is illustrated in FIGS. 1 and 4 are defined by surface 10, outer port radius 36 and inner port radius 38 as well as the depth 60. Therefore, as the volume of expanding pockets 52 expands, the cross-sectional area of intake port in the direction of rotation diminishes. Since the axial depth of rotors 20 and 22 are constant, the cross-sectional area of intake port 16 will vary inversely with the area of the expanding pockets 52. The exhaust port 18 is constructed in a similar fashion. It should be noted from FIG. 4 that the depth of intake port 16 to the right of DE, is relatively constant and diminishes in the direction of rotation 18 from DE, onwards, that is just past the introduction of fluid from the intake passage 12.

The depth of the port 16 and 18 are manufactured as an interpellated curve where the cross-sectional area of the port 16 and 18 respectively is in relation to the gear pocket rate of change.

Moreover, the vector flow angle which is shown as number 70 in FIG. 4 which comprises of the vector addition of the horizontal and vertical component of the velocity of the oil is constantly decreased from the beginning of the port to the end of the port. In this way, it is believed that the acceleration of the fluid or intake oil is constant within the entire port area and the final velocity of the oil flow at the end of the intake port is nearly equal to the rotor pitch line velocity.

Accordingly, the system as described herein allows the oil to flow smoothly into the separating gear sets with substantially no unnecessary acceleration or deceleration of oil in the port area. Since constant acceleration ports are generally shallower than standard gerotor ports, such systems can be prone to some high speed cavitation due to shearing of the oil between the rotor face and the bottom of the port. Accordingly, a relief conduit 80 is utilized which is adapted to receive a relief valve as shown in FIG. 1 in order to minimize the cavitation potential. Since the constant acceleration ports will allow for smooth intake and exhaust pressure pulses, the relief oil can be directed into the intake port in such a way that the system as shown herein becomes pulse tuned. The velocity profile of the relief oil is analyzed and the relief conduits are shaped and sized to inject the oil into the maximum rate of change area of the intake port at the correct velocity and time. The internal energy in the relief oil is used to assist in the acceleration of the intake oil reducing the intake pressure drop and minimizing the cavitation potential. The injected oil also maximises the mechanical efficiency of the pump by using energy which will otherwise be wasted. Details concerning the relief valve are subject matter of a patent application filed by applicant on even data of this application.

Accordingly, the invention as described herein relates to pulse tuned optimized porting whereby the incremental rate of change of the cross-sectional area of the intake port is equal to the rate of change of the pocket of the area between the rotor teeth as they open up. The rate of change of the pocket area and hence the depth of the port varies with the angle of rotation of the rotors with the maximum near the centre of the port where the rate of change of the opening of the pocket is the greatest, while at both ends of the port, the rate of change of the depth is close to zero.

When designing or constructing the ports as described herein, the initial and final port depth is predetermined by the user. The incremental ratio of the rate of change of the rotor pockets will be applied to the total difference of the initial and final port depth. The actual port depth at a particular angle of rotor rotation will be calculated by the combination of the differentially based constant velocity (resulting in the port cross section) and the constant accelerating slope of the initial and final port depth. The final profile of the port will be manufactured into the housing. The exhaust port can be obtained by mirroring the intake port about the off-set of the housing. Through the use of specialized port shapes and flow velocity optimization or port vectorization, the system can be integrated and optimized to minimize cavitation and maximize pump efficiency.

Although the preferred embodiment as well as the operation and use have been specifically described in relation to the drawings, it should be understood that variations in the preferred embodiment could be achieved by a person skilled in the trade without departing from the spirit of the invention. Accordingly, the invention should not be understood as to be limited to the exact form revealed by the drawings.

The embodiments of the invention in which an exclusive property or privilege is claimed are defined as follows:

1. In a porting system for a hydraulic device comprising:

(a) housing means having a chamber communicating with an intake port and an exhaust port;

(b) gear means disposed internally of said chamber adjacent said ports and defining expanding and contracting pockets as said gear means rotates over said intake port and said exhaust port respectively;

(c) said ports having a cross-sectional area in the direction of said rotation which varies with the angular displacement of said gear means whereby the incremental rate of change of said cross-sectional area is based on said rate of change of said expanding and contracting pockets.

2. In a porting system as claimed in claim 1 wherein said cross-sectional area of said ports varies inversely in relation to the rate of change of said expanding and contracting pockets.

3. In a porting system as claimed in claim 2 wherein the incremental rate of change of said cross-sectional area of said intake port in the direction of rotation of said gear means is proportional to the rate of change of said expanding pockets as said gear means rotates over said intake port.

4. In a porting system as claimed in claim 3 wherein the incremental rate of change of said cross-sectional area of said exhaust port in the direction of rotation of said gear means is proportional to the rate of change of said contracting pockets as said gear means rotates over said exhaust port.

5. In a porting system as claimed in claim 4 wherein said incremental rate of change of said cross-sectional area of said intake port and said exhaust port are inversely proportional to the rate of change of said expanding and contracting pockets respectively as said gear means rotates over said intake port and said exhaust port.

6. In a porting system as claimed in claim 5 wherein said gear means comprises rotor gear means defining a plurality of expanding and contracting pockets as said rotor gear means rotates about a fixed axis.

7. In a porting system as claimed in claim 6 wherein said intake port has an axial depth which varies with said angle of rotation of said rotor gear means.

8. In a porting system as claimed in claim 7 wherein said exhaust port has an axial depth which varies with said angle of rotation of said rotor gear means.

9. In a porting system as claimed in claim 8 wherein the change of said axial depth of said ports is greatest in the region near the centre of said port where said rate of change of said pockets is the greatest.

10. In a porting system as claimed in claim 9 wherein each said port presents opposite ends in the direction of said rotation where said rate of change of said axial depth of said port approaches zero.

11. In a porting system as claimed in claim 10 further including relief conduit means connecting said intake port and said exhaust port with relief valve means for closing and opening said relief conduit means.

12. A hydraulic device of pumping fluids comprising:

(a) a housing having an intake passage for introducing said fluid, exhaust passage for exhausting said fluid, and an end face, said intake and exhaust passages defining at said end face an intake port for receiving said fluid and an exhaust port for exhausting said fluid;

(b) internally toothed rotor means having an axis of rotation and an externally toothed rotor means eccentrically disposed within said internally toothed rotor means and having an axis of rotation, said axis of rotation being spaced apart;

(c) shaft means operatively connected to one of said rotor means;

(d) said teeth of said rotor means interengageable to define a plurality of expanding and contracting volumes as said rotor means rotate over said intake port and said exhaust port respectively;

(e) said port means having a cross-sectional area in said axial direction which changes with the angular displacement of said rotor means whereby the incremental rate of change of said cross-sectional area along the entire said port is inversely proportional to the incremental rate of change of said expanding and contracting volumes, respectively.

13. In a hydraulic device as claimed in claim 12 wherein said end face is disposed substantially perpendicular to said axis of rotation.

14. In a hydraulic device as claimed in claim 13 wherein said internally and externally toothed rotor means have the same axial dimension.

15. In a hydraulic device as claimed in claim 14 wherein said rotor means have a common axial depth so as to define expanding and contracting pocket areas between said rotor means as said rotor means rotate over said intake port and said exhaust port respectively, and, wherein said ports have an axial depth which varies inversely in proportion to said expanding and contracting pocket areas.

16. In a method of maintaining a substantially constant acceleration of fluid within the entire area of an intake port and exhaust port defined by an intake passage and exhaust passage communicating with a chamber having rotary gear means defining expanding and contracting pockets as said rotary gear means rotates within said chamber by utilizing said ports having a cross-sectional area in the direction perpendicular to said rotation of said rotary gear means which varies with the angular displacement of said rotary gear means whereby the incremental rate of change of said cross-sectional area is inversely proportional to said rate of change of said expanding and contracting pockets.

17. In a method as claimed in claim 16 wherein said fluid communicates with said intake port with an initial vector flow angle at the beginning of said port said vector flow angle being constantly decreased to a final vector flow angle at the end of said intake port so as to maintain a substantially constant acceleration of fluid within the entire area of said intake port.

18. In a method as claimed in claim 17 wherein said vector flow angle has a velocity component which is constantly being increased from the beginning of said port to the end of said port.

19. In a method as claimed in claim 18 wherein said fluid vector has a velocity substantially similar to the pitch line velocity of said rotary gear means, at the end of said intake port and at the beginning of said exhaust port.

20. In a method of producing an intake port and an exhaust port in a hydraulic device having a fluid chamber with rotary gear means disposed within said fluid chamber adjacent said ports so as to define expanding and contracting pockets as said rotary gear means rotates about an axis within said chamber, said method comprising the steps of:

(a) determining the radial and axial size of said ports;
(b) determining the initial and final depth of said ports;
(c) determining the rate of change of said pockets as rotary gear means rotates about said ports; and
(d) manufacturing the depth of said ports wherein the cross-sectional area of said ports varies in relation to the rate of change of said expanding and contracting pockets.

* * * * *